US007130714B1

(12) United States Patent
Kulkarni et al.

(10) Patent No.: US 7,130,714 B1
(45) Date of Patent: Oct. 31, 2006

(54) METHOD OF PREDICTING SPRINGBACK IN HYDROFORMING

(75) Inventors: Pravin Kulkarni, Wichita, KS (US); Subhrangshu Datta, Wichita, KS (US); Mark A. Virginia, Haysville, KS (US)

(73) Assignee: Cessna Aircraft Company, Wichita, KS (US)

( * ) Notice: Subject to any disclaimer, the term of this patent is extended or adjusted under 35 U.S.C. 154(b) by 0 days.

(21) Appl. No.: 10/866,452

(22) Filed: Jun. 11, 2004

(51) Int. Cl.
*B21C 1/00* (2006.01)

(52) U.S. Cl. ..... 700/165; 700/52; 700/193; 72/702; 703/2

(58) Field of Classification Search ..... 700/165, 700/98, 127, 193, 52; 72/31.1, 389.3, 702; 703/1, 2, 7; 702/155
See application file for complete search history.

(56) References Cited

U.S. PATENT DOCUMENTS

| | | | | |
|---|---|---|---|---|
| 4,802,357 | A | 2/1989 | Jones | 72/389 |
| 4,989,439 | A | 2/1991 | Ewert | 72/372 |
| 5,839,310 | A * | 11/1998 | Tokai et al. | 72/702 |
| 5,857,366 | A * | 1/1999 | Koyama | 72/31.1 |
| 6,161,408 | A | 12/2000 | Ooenoki et al. | 72/31.01 |
| 6,292,716 | B1 * | 9/2001 | Moore et al. | 700/193 |
| 6,522,979 | B1 * | 2/2003 | Yavari et al. | 702/42 |
| 6,785,640 | B1 * | 8/2004 | Lu et al. | 703/7 |
| 6,796,155 | B1 * | 9/2004 | Koyama et al. | 72/31.11 |
| 2003/0015011 | A1 * | 1/2003 | Koyama et al. | 72/31.1 |
| 2003/0050765 | A1 * | 3/2003 | Sasahara | 702/155 |
| 2003/0061852 | A1 | 4/2003 | Yamano et al. | 72/306 |

OTHER PUBLICATIONS

Erik Enroth, Sheet Metal Forming in Quintus Fluid Cess Press, Apr. 1980, Issue 3, Quintus Press Department, Sweden.

* cited by examiner

*Primary Examiner*—Leo Picard
*Assistant Examiner*—Charles Kasenge
(74) *Attorney, Agent, or Firm*—Robert O. Blinn

(57) ABSTRACT

A method of determining springback in metal forming with a fluid cell press through establishing a computational formulation to determine bend angle and compensated die radius based on factors of geometry of the part being formed, material properties of the sheet material and the forming process, and computing additional iterations of springback until a specific tolerance between the formed part angle and the desired part angle are reached.

10 Claims, 5 Drawing Sheets

METHOD OF PREDICTING SPRINGBACK IN HYDROFORMING

BACKGROUND OF THE INVENTION

1. Field of the Invention

This invention relates to bending methods for forming sheet metal parts and more specifically for calculating springback when forming parts by hydroforming with a fixed die and hydraulic pressure exerted by a flexible diaphragm.

2. Description of Prior Art

With the advent of metal airplanes, it became necessary to find a method of forming complex sheet metal parts economically. Traditional stamping methods, also referred to as draw forming, involve high tool costs that could not be justified for the relatively small quantities of parts produced. Traditional stamping required two mating precisely aligned dies. Hydroforming, also referred to as fluid forming, involves only a single die wherein the hydraulic pressure was applied against a flexible diaphragm, which forms the sheet material against a die.

Various other metal forming methods are utilized in the various industries such as a stretch press, wherein the work piece is stretched over a single die. The brake press is another commonly used method, which deals with more simplified two-dimensional bends.

When a metal workpiece is deformed during a metal forming operation, the deformation thus given has two components—elastic and plastic. Upon removal of the forming load, while the plastic component remains unchanged, the elastic component is recovered. The magnitude of this recovery is called springback. All metal forming methods thus have to deal with the springback problem. During sheet bending, this recovery or springback is manifested in the workpiece in the form of an increased part angle and radius of bend than that desired. The shape of the workpiece springs back to a shape, which is almost never the shape optimally desired nor the shape of the bending die. In the prior art this required re-cutting the forming die numerous times, which is very costly and time consuming.

One method to solve this problem has been to cause the workpiece to be excessively bent in the bending direction such that upon springback the workpiece can assume the proper shape. This method requires the die designer to guess at the shape of the bending die, which can be very costly if incorrect.

Solving the springback problem has been addressed in various other metal forming methods such as the patent to Ewert, U.S. Pat. No. 4,989,439 in a stretch press process; the patent to Jones, U.S. Pat. No. 4,802,357 and Ooenoki et al, U.S. Pat. No. 6,161,408, both of which deal with methods for compensating for springback in the brake press field of metal forming. The patent to Yamano et al, Pub. No. US 2003/0061852 deals with calculated springback in the conventional draw forming method of metal forming.

Research to predict springback in hydroforming, has been very limited and is exemplified in a publication entitled "Sheet Metal Forming in the Quintus® Fluid Cell Press" published in April of 1980 and authored by Eric Enroth, published by the Quintus Press Department. This publication provides some rules of thumb for springback allowances for different materials irrespective of geometric or process conditions. Commonly used springback prediction tools in the industry are based on experiments done for a specific bend angle (90 degrees) for specific materials, and springback charts obtained by doing tests on specific geometric conditions. The springback is predicted for different geometric conditions on the basis of limited data and arbitrary extrapolations; therefore, their prediction is not precise. Process parameters are not considered in these methods and any process variation during manufacturing alters springback. There is no single tool available that can accurately predict the total springback for all parts irrespective of material, process and geometric condition.

SUMMARY OF THE INVENTION

The only way to control springback in any forming process is to be able to accurately predict springback. This requires understanding all the different factors and their respective interactions that influence springback.

The significant factors influencing springback can be divided into the following three groups:

1. Geometric factors: Which include; a) part geometry, b) bend radius, c) part angle, and d) sheet thickness.
2. Process factors: Which include; a) forming pressure, b) type of hydropress, c) type of lubricant used and friction coefficient, and d) hardness of rubber.
3. Material factors: Which include; a) yield strength, b) elastic modulus, c) lot variability, d) material hardening (strain and work hardening), and e) anisotropy.

The computational formulation for calculating springback takes into account process, geometric and material factors during the bending operation using hydroforming to predict the amount of springback.

The problems in the prior methods of accurately predicting springback are numerous. They don't include process factors; they don't consider interactions between the geometric and material factors; they include incorrect assumption of angle of bend resulting in incorrect prediction; they don't include repetitive physical iterations to the die angle and springback to achieve the part angle after springback.

It is, therefore, the principal object of the present invention to provide a method for accurately calculating springback by establishing a computational formulation which includes factors involving geometry, material properties and forming process factors.

Another object of the present invention is the method of calculating total compensated springback and compensated die radius based on factors of geometry, material properties and forming process factors and then computing additional iterations of die angle and springback prediction until the formed part angle and design part angle are the same.

DESCRIPTION OF THE DRAWINGS

The accompanying drawings which are incorporated in and constitute a part of the specification illustrate an embodiment of the invention and the steps of the method for practicing the invention and together with the description, serve to explain the principals of the invention.

DETAILED DESCRIPTION OF THE PREFERRED EMBODIMENT

Figure 1:
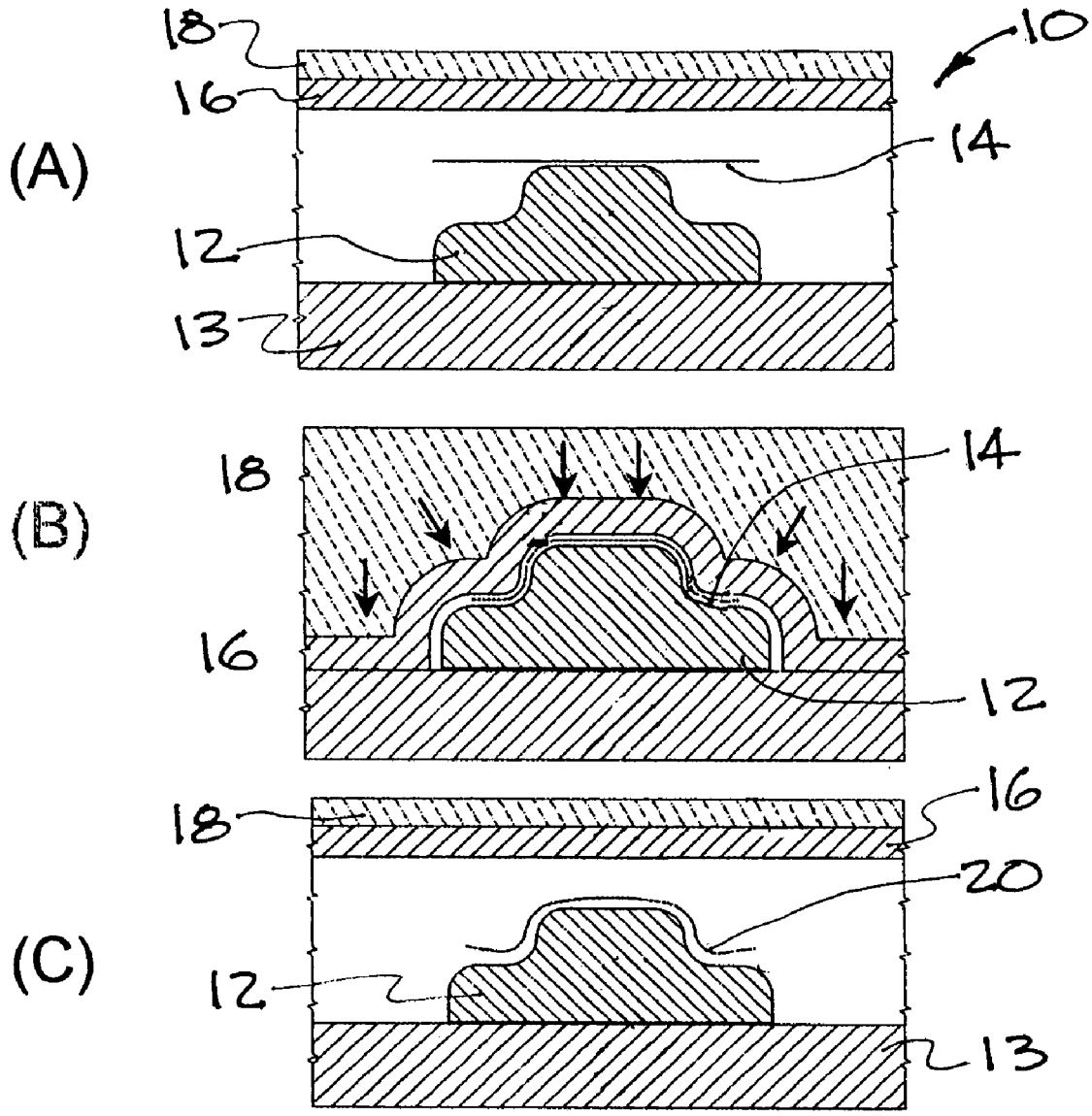
FIG. 1 is a schematic view of a fluid cell hydropress in various stages.

Hydroforming, sometimes referred to as fluid forming or rubber diaphragm forming, was developed in response to a need for a low cost method of producing relatively small quantities of a wide variety of sheet metal parts. The principal of forming in a typical hydropress is illustrated in FIG. 1. It symbolically illustrates a typical hydropress before the forming starts in Illustration "A"; pressure being applied on the diaphragm or bladder to form the part in Illustration "B"; and removal of the part after the pressure of the bladder is relieved in Illustration "C". The tool 12 is placed in the hydropress 10 on a fixed table 13. A sheet metal blank 14 placed on top of the tool 12. A rubber diaphragm 16 in the "A" illustration is shown retracted with unpressurized fluid 18 positioned above the diaphragm. In Illustration "B" the fluid 18 is pressurized thus causing diaphragm 16 to extend downward forming the blank 14 around the tool 12. The high pressure fluid above that diaphragm 16 is relieved as shown in Illustration 3, whereupon table 13 is rolled out of the press 10 and the formed part is removed from the tooling.

Figure 3:
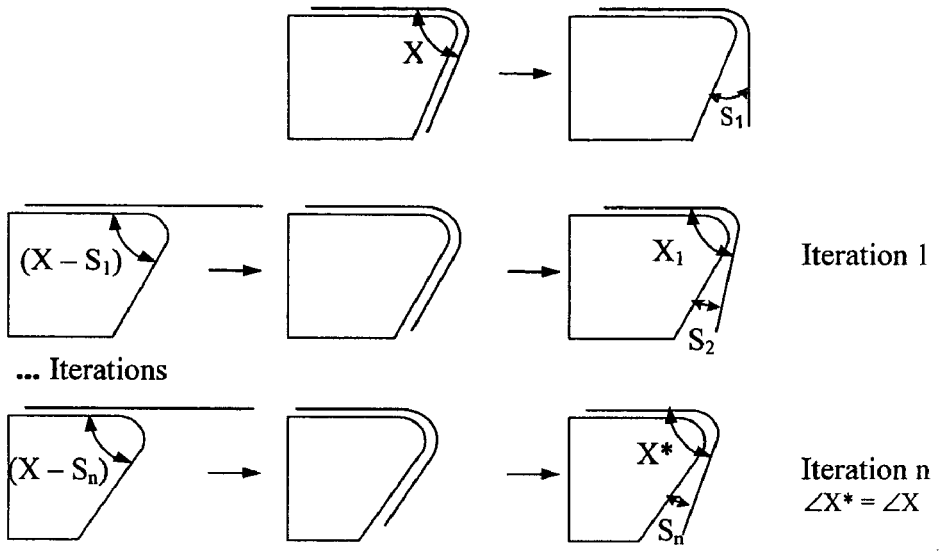
FIG. 3 is a schematic illustration of a series of iterations for calculating total compensated springback.

Once the formed part 20 is unloaded in the press, it tries to regain its original shape. This difference is called springback. In FIG. 3, a blank 22 is hydroformed on tool 24 with a design part angle X. Once the hydropress diaphragm is retracted blank 22 springs back to an initial springback angle of $S_1$, which is the initial springback prediction. To account for springback, the magnitude of the die angle must be reduced to $X-S_1$, as shown in the first iteration with a tool angle of $X-S_1$. A theoretical blank is hydroformed as shown in iteration No. 1, which when released from the press has springback angle of $S_2$. Therefore, die angle for the next iteration needs to be $X-S_2$. With each additional iteration, the predicted springback S increases. The iterations are performed till the sum of the die angle and the predicted springback reaches the precise part angle X. The predicted springback at this point is the total compensated springback, $S_N$ and the formed part is at the precise angle of the designed part.

Figure 2:
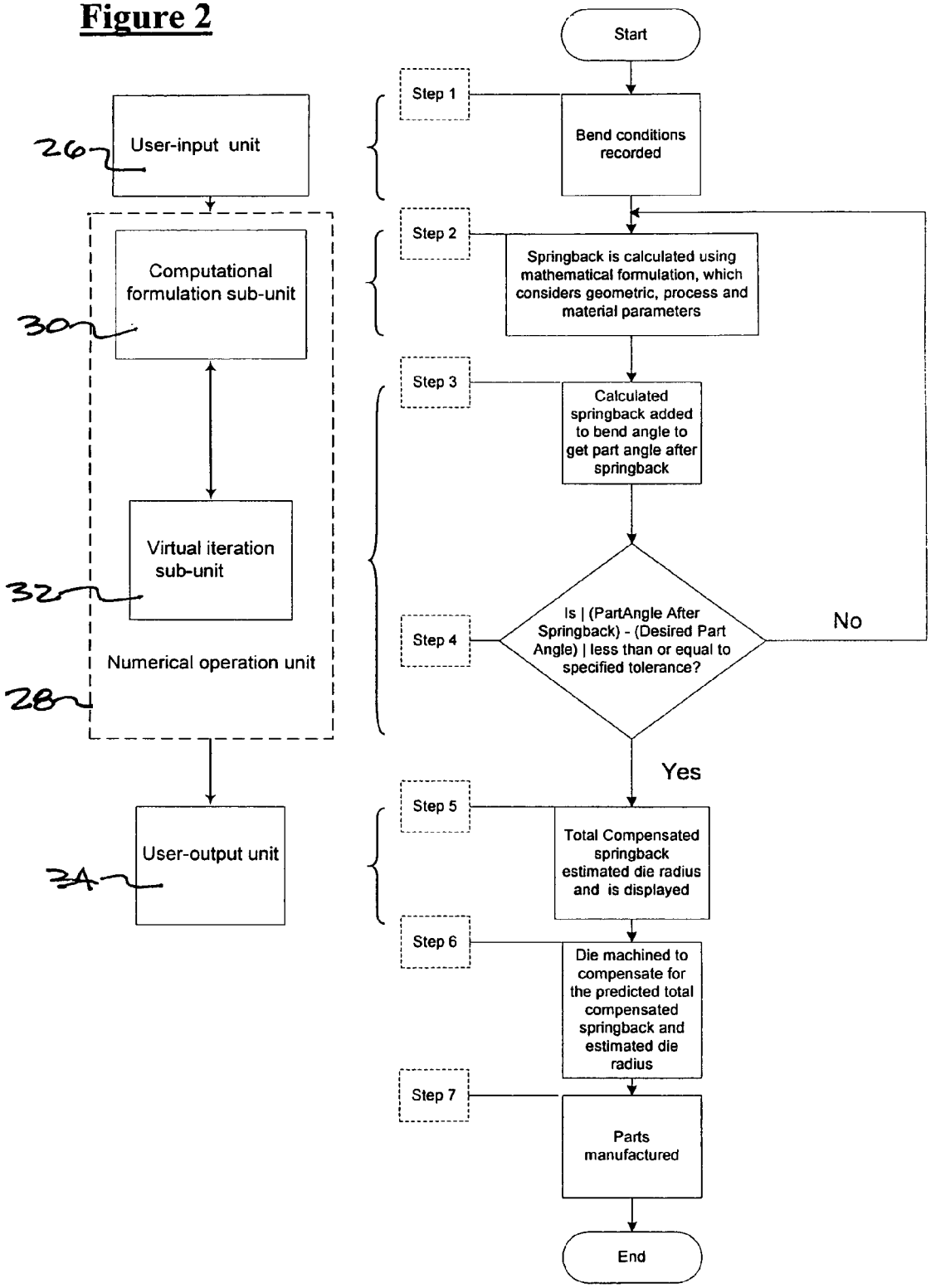
FIG. 2 is a block diagram illustrating the steps of the method for determining the amount of over-bend required to compensate for springback in workpiece.

Referring next to FIG. 2, there is shown a flow chart and a system diagram of the computational application utilizing the disclosed method. In unit 26, the user is required to input bend conditions for the bending process that include material, process and geometric parameters. This information is fed into the numerical operation unit 28. Within unit 28 are two sub-units, computational formulation unit 30 and virtual iteration loop unit 32. The sub-unit 30 uses a mathematics formulation involving all material, process and geometric parameters and their interactions to predict springback. Unit 32 then proceeds through the iterations to predict the total compensated springback. The format of the formulation is as follows:

Springback=*A*+*B*(Thickness)+*C*(Pressure)+*D*(Bend Radius)+*E*(Die Angle)+*F*(Hydropress)+*G*(Thickness)(Pressure)+*H*(Thickness)(Bend Radius)+*I*(Thickness)(Die Angle)+*J*(Thickness)(Hydropress)+*K*(Pressure)(Bend Radius)+*L*(Pressure)(Die Angle)+*M*(Pressure)(Hydropress)+*N*(Bend Radius)(Die Angle)+*O*(Bend Radius)(Hydropress)+*P*(Die Angle)(Hydropress)+*Q*(Thickness)(Pressure)(Bend Radius)+*R*(Thickness)(Pressure)(Die Angle)+*S*(Thickness)(Pressure)(Hydropress)+*T*(Thickness)(Bend Radius)(Die Angle)+*U*(Thickness)(Bend Radius)(Hydropress)+*V*(Thickness)(Die Angle)(Hydropress)+*W*(Pressure)(Bend Radius)(Die Angle)

The values of the constants A–W are as follows for the three aluminum sheet stocks listed:

| Constant | AA 2024-T3 (ISO Al Cu 4 Mgl) | AA 2024-T4 Tform/2524-T3 |
|---|---|---|
| A | 6.5766 | 14.9827 |
| B | 12.444 | −247.431 |
| C | 0.00138 | 0.0000759 |
| D | 140.113 | 81.4027 |
| E | 1.1835 | −0.01518 |
| F | 0 | −0.782 |
| G | 0 | −0.00412 |
| H | 1925.3 | −489.422 |
| I | 1.7394 | 2.0696 |
| J | 0 | 0 |
| K | 0.00149 | 0 |
| L | 0.000031 | 0 |
| M | 0 | 0.00006203 |
| N | −0.3195 | −0.35584 |
| O | 0 | 0 |
| P | 0 | 0 |
| Q | 0 | 0 |
| R | 0 | 0 |
| S | 0 | 0 |
| T | 16.352 | 0 |
| U | 0 | 0 |
| V | 0 | 0 |
| W | −0.000016 | 0 |

The following variables in the equation in parenthesis are; (thickness) of the blank; (pressure) in the hydropress; die (bend radius); (die angle) and (hydropress) type.

The variables in formulation are in parenthesis; for example, (pressure) represent mathematical terms involving pressure utilized in the hydropress. The terms (thickness)(pressure) represent interaction between the respective parameters. The material parameters have been included by formulating individual springback prediction equations for each individual material by performing experiments over a wide range of material production lots for the respective material.

The consideration of material, process and geometric parameters and their interactions helps estimate the springback with very high accuracy. In FIG. 2, sub-unit 32 tries to minimize the differences between design and formed part angles after unloading of the fluid pressure. It uses design part angle X in FIG. 3 to obtain initial springback prediction $S_1$ but then iteratively predicts springback based on the new forming angle until the part angle is equal to the design part angle ($\angle X^* = \angle X$). These iterations are done on the computer within a few seconds as compared with hours in resources spent on physical shop trials. The iterative springback thus predicted is called the total compensated springback, as shown in the following chart. The numerical operation unit 28 uses the total compensated springback to calculate the compensated die radius. The compensated die radius would be different from the desired part radius owing to compensation of the die by the total compensated springback. The formulation used to calculate the compensated die radius is as follows:

$$\text{Compensated die radius} = \frac{\text{Designed part radius } (180 - \text{Designed part angle})}{180 - \text{Designed part angle} + \text{Total compensated springback}}$$

The calculated total compensated springback and estimated die radius are displayed in user-output unit 34 in FIG. 2.

The operation of the application is illustrated below:

| User - Input Unit: | |
|---|---|
| Material: 2024-T3 | Bend radius: 0.250" |
| Sheet thickness: 0.032" | Part angle (∠A): 60° |
| Forming pressure: 8000 psi | Hydropress: ASEA |

Assume specified tolerance for formed part (Part angle after springback − Desired part angle) = 0°

Computation formulation and iteration (30 and 32):

| Iteration | Die angle (X-$S_n$) | Predicted springback ($S_n$) | Formed part angle after springback | Difference between formed and design part angles |
|---|---|---|---|---|
| | 60.00° (X) | 18.76° ($S_1$) | | |
| 1 | 41.24° | 21.166° ($S_2$) | 62.406° ($X_1$) | 2.406° |
| 2 | 38.834° | 21.475° ($S_3$) | 60.309° ($X_2$) | 0.309° |
| 3 | 38.525° | 21.515° ($S_4$) | 60.040° ($X_3$) | 0.040° |
| 4 | 38.485° | 21.519° (SX) | 60.004° ($X_4$) | 0.004° |
| 5 | 38.480° | 21.520° (Total compensated springback) | 60.000° (X*) | 0.000° |

We now refer to FIG. 2 and the above table to understand the operation of the virtual iteration loop 32. To begin the virtual iteration loop operation, the sub-unit 30 uses the design part angle (∠X=60°) to obtain the initial springback prediction (∠$S_1$=18.76°).

Iteration 1: The sub-unit 30 uses the predicted springback (∠$S_1$=18.76°) to compensate the die to obtain the forming angle for Iteration 1 (Forming angle=Die angle=Desired part angle, ∠X−Predicted springback, (∠$S_1$=41.24°). It then uses the forming angle (41.24°) to predict the new springback (∠$S_2$=21.166°). The sub-unit 32 now adds the thus calculated springback (21.166°) to the forming angle (41.24°) to obtain the formed part angle after springback ($X_1$=21.166°+41.24°=62.406°). As indicated in FIG. 2, the sub-unit 32 then compares the difference between the formed part angle after springback and the part angle to the specified tolerance (0°). Since the difference (2.406°) is greater than the specified tolerance (0°), the process moves back to sub-unit 32 for Iteration 2.

Iteration 2: The sub-unit 32 uses the predicted springback (∠$S_2$=21.166°) to compensate the die to obtain the forming angle for Iteration 2 (Forming angle=Die angle=Design part angle, ∠X−Predicted springback, (∠$S_2$=38.834°). It then uses the forming angle (38.834°) to predict the new springback (∠$S_3$=21.475°). The sub-unit 32 now adds the thus calculated springback (21.475°) to the forming angle (38.834°) to obtain the formed part angle after springback ($X_2$=21.475°+38.834°=60.309°). The sub-unit 32 then compares the difference between the formed part angle after springback and the desired part angle to the specified tolerance (0°). Since the difference (0.309°) is greater than the specified tolerance (0°), the process moves back to sub-unit 32 for Iteration 3.

Iterations 3 through 5: The process is repeated till the formed part angle after springback (X*) is equal to the desired part angle. The predicted springback at end of the final iteration (Iteration 5) is the total compensated springback (21.520°).

The unit 28 finally calculates the compensated die radius as follows:

$$\text{Compensated die radius} = \frac{\text{Designed part radius } (0.25')(180 - \text{Designed part angle } (60°)}{180 - \text{Designed part angle } (60°) + \text{Total compensated springback } (21.52°)} = 0.2119''$$

| User-output (34) | |
|---|---|
| Total compensated springback: | 21.520° |
| Compensated die radius: | 0.2119" |

Figure 4:
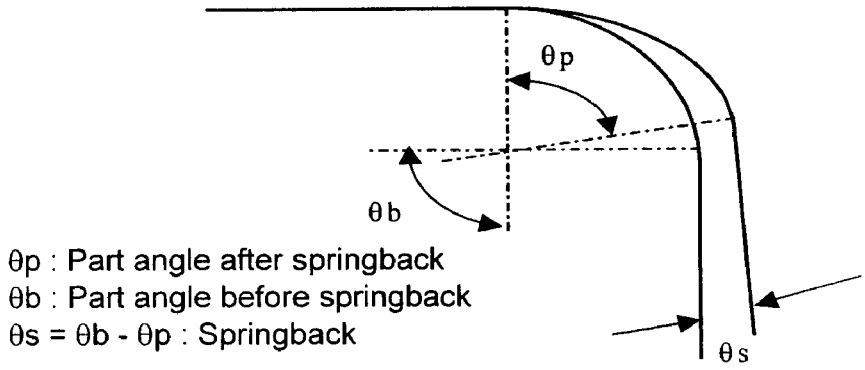
FIG. 4 is a schematic for springback measurement.

FIG. 4 illustrates springback in terms of the part angle before springback θb and the part angle after springback θp wherein the springback is equal to θb minus θp.

Figure 5:
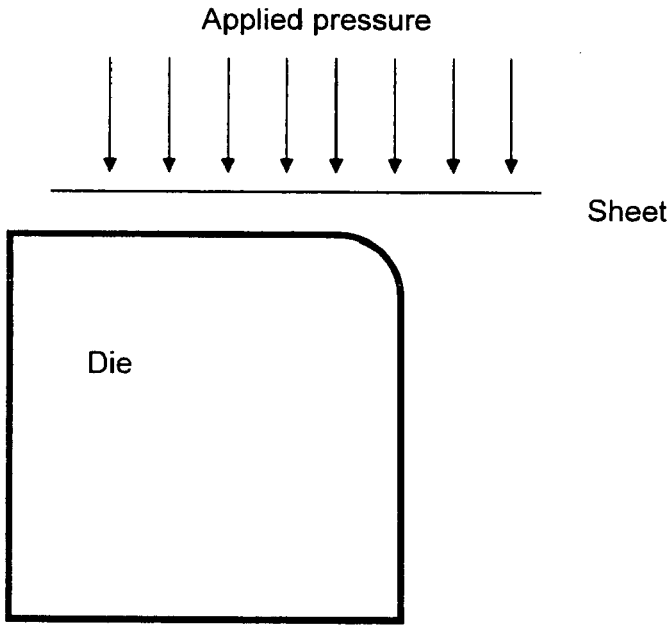
FIG. 5 is schematic illustration of the forces involved in hydroforming.

FIG. 5 illustrates how hydraulic forming pressure is applied to the blank as it wraps around the die.

Figure 6:
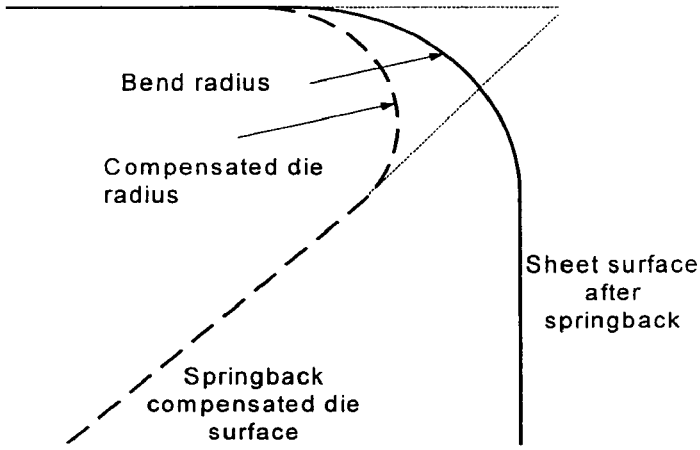
FIG. 6 is a schematic drawing showing the dependency of the die radius on accurate prediction springback; and, FIG. 7 is an example of a web-based application utilizing the disclosed method of present invention.

FIG. 6 is a graphic representation of how the bend radius of the part changes with a change in the springback compensated die surface.

Figure 7:
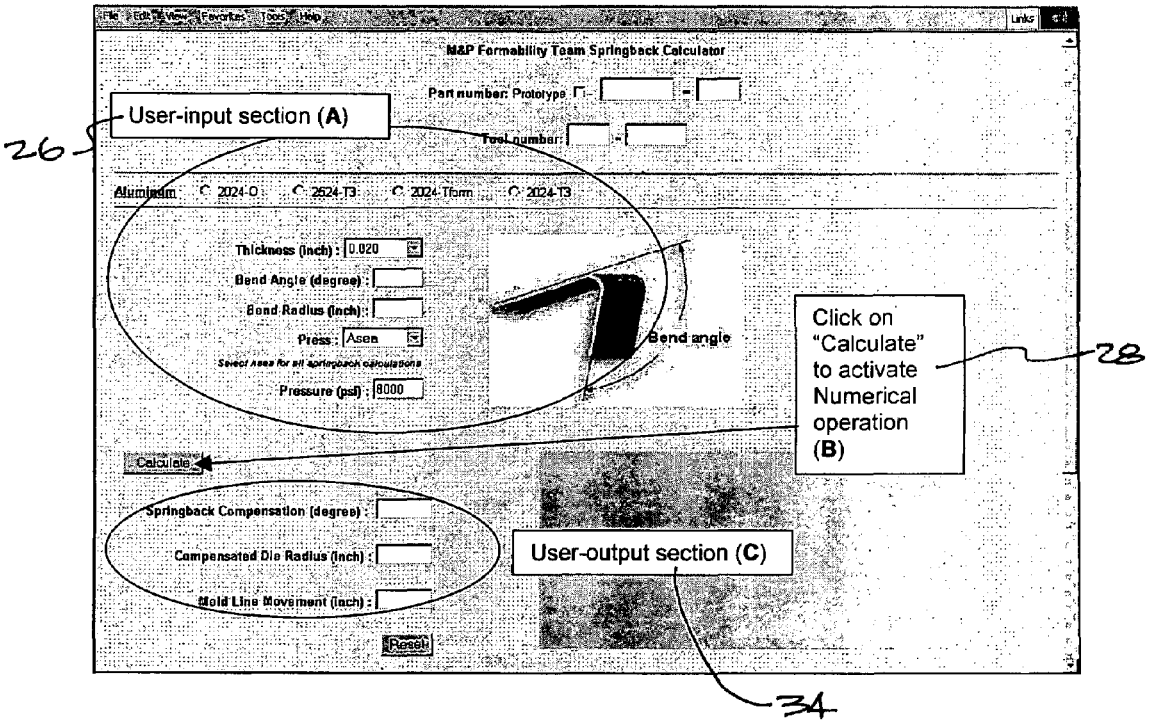

FIG. 7 illustrates the user input section 26 in the computer where the various variables such as material thickness, bend angle, bend radius, model of hydropress and pressure are inputted into the computer for calculations of springback and compensated die radius.

The hydropress choices include an Asea press and a Quintus press.

Additional advantages and modifications will readily occur to those skilled in the art. In the invention in its broader aspects is, therefore, not limited to the specific details, representative apparatus and illustrated examples shown and described. Accordingly, departures may be made from such details without departing from the spirit or scope of applicants' general inventive concept.

What is claimed is:

1. A method of determining springback in metal forming by a fluid cell hydropress of sheet material comprising the steps of:

establishing a computational formulation to calculate springback wherein the formulation includes factors involving, the geometry of the part being formed, material properties of the sheet material, and forming process factors including pressure, cycle time, and specific model fluid cell hydropress;

calculating the estimated springback through use of said formula by inputting the data of the various said factors, and, calculating additional iterations in springback through adjustment of the die angle and the bend radius until a tolerance of 0.001° is reached.

2. The method of determining springback—as set forth in claim 1 wherein, springback is determined using the following equation:

Springback=*A*+*B*(Thickness)+*C*(Pressure)+*D*(Bend Radius)+*E*(Die Angle)+*F*(Hydropress)+*G*(Thickness)(Pressure)+*H*(Thickness)(Bend Radius)+*I*(Thickness)(Die Angle)+*J*(Thickness)(Hydropress)+*K*(Pressure)(Bend Radius)+*L*(Pressure)(Die Angle)+*M*(Pressure)(Hydropress)+*N*(Bend Radius)(Die Angle)+*O*(Bend Radius)(Hydropress)+*P*(Die Angle)(Hydropress)+*Q*(Thickness)(Pressure)(Bend Radius)+*R*(Thickness)(Pressure)(Die Angle)+*S*(Thickness)(Pressure)(Hydropress)+*T*(Thickness)(Bend Radius)(Die Angle)+*U*(Thickness)(Bend Radius)(Hydropress)+*V*(Thickness)(Die Angle)(Hydropress)+*W*(Pressure)(Bend Radius)(Die Angle), and wherein the calculation additional iterations in springback through adjustment of the die angle and the bend radius proceeds until a preselected tolerance is reached.

3. A method of shaping a sheet metal workpiece to a desired part angle and desired part radius utilizing calculated springback comprising the step of:

computing the total compensated springback using the following equation:

$$\text{Springback}=A+B(\text{Thickness})+C(\text{Pressure})+D(\text{Bend Radius})+E(\text{Die Angle})+F(\text{Hydropress})+G(\text{Thickness})(\text{Pressure})+H(\text{Thickness})(\text{Bend Radius})+I(\text{Thickness})(\text{Die Angle})+J(\text{Thickness})(\text{Hydropress})+K(\text{Pressure})(\text{Bend Radius})+L(\text{Pressure})(\text{Die Angle})+M(\text{Pressure})(\text{Hydropress})+N(\text{Bend Radius})(\text{Die Angle})+O(\text{Bend Radius})(\text{Hydropress})+P(\text{Die Angle})(\text{Hydropress})+Q(\text{Thickness})(\text{Pressure})(\text{Bend Radius})+R(\text{Thickness})(\text{Pressure})(\text{Die Angle})+S(\text{Thickness})(\text{Pressure})(\text{Hydropress})+T(\text{Thickness})(\text{Bend Radius})(\text{Die Angle})+U(\text{Thickness})(\text{Bend Radius})(\text{Hydropress})+V(\text{Thickness})(\text{Die Angle})(\text{Hydropress})+W(\text{Pressure})(\text{Bend Radius})(\text{Die Angle});$$

and computing additional iterations of springback through adjustment of the die angle and bend radius until a specific tolerance between the formed part angle and designed part angle is reached.

4. The method of claim 3 wherein bend radius is replaced by a compensated die radius which is determined using the following equation:

$$\text{Compensated die radius} = \frac{\text{designed part radius} \times (180 - \text{designed part angle})}{180 - \text{designed part angle} + \text{Total compensated springback}}.$$

5. The method of determining springback as set forth in claim 3 including the additional step of:

calculating additional iterations in springback through adjustment of die angle and bend radius until a tolerance of 0.001° is reached.

6. A method for determining a forming die angle for a die for use in the hydropress forming of a sheet metal part to substantially conform to a design part angle, comprising the step of:

(a) establishing a design part angle, (b) calculating a predicted springback angle using the design part angle, (c) determining a new forming angle by subtracting the predicted springback angle from the design part angle, (d) determining a new predicted springback angle using the new forming angle determined in step (c), (e) repeating steps (c) and (d) until the difference between the design part angle and the sum of the new forming angle determined in step (c) and the new predicted springback angle determined in step (d) is less than a preselected tolerance angle and then using the last new forming angle for the die angle.

7. The method of claim 6, wherein;

the determination of the first predicted springback angle in step (b) and the new predicted springback angle in step (d) are determined by using a computational formula including factors dependent upon the geometry of the part, material properties of the sheet material, and forming process factors including pressure and cycle time.

8. The method of claim 6, wherein;

the determination of the first predicted springback angle in step (b) and the new predicted springback angle in step (d) are determined by using a computational formula including factors involving the geometry of the part including bend radius, material properties of the sheet material and forming process factors including pressure and cycle time, wherein, after step (b) the value for bend radius in the computational formula is replaced by a compensated die radius which is determined as follows:

$$\text{compensated die radius} = \frac{\text{designed part radius} \times (180 - \text{designed part angle})}{180 - \text{designed part angle} + \text{previous springback value}},$$

and wherein the previous springback value used in the above equation is the most recent new springback value determined in step (d).

9. The method of claim 6, wherein;

the determination of the first predicted springback angle in step (b) and the new predicted springback angle in step (d) are determined by using the following equation:

$$\text{Springback}=A+B(\text{Thickness})+C(\text{Pressure})+D(\text{Bend Radius})+E(\text{Die Angle})+F(\text{Hydropress})+G(\text{Thickness})(\text{Pressure})+H(\text{Thickness})(\text{Bend Radius})+I(\text{Thickness})(\text{Die Angle})+J(\text{Thickness})(\text{Hydropress})+K(\text{Pressure})(\text{Bend Radius})+L(\text{Pressure})(\text{Die Angle})+M(\text{Pressure})(\text{Hydropress})+N(\text{Bend Radius})(\text{Die Angle})+O(\text{Bend Radius})(\text{Hydropress})+P(\text{Die Angle})(\text{Hydropress})+Q(\text{Thickness})(\text{Pressure})(\text{Bend Radius})+R(\text{Thickness})(\text{Pressure})(\text{Die Angle})+S(\text{Thickness})(\text{Pressure})(\text{Hydropress})+T(\text{Thickness})(\text{Bend Radius})(\text{Die Angle})+U(\text{Thickness})(\text{Bend Radius})(\text{Hydropress})+V(\text{Thickness})(\text{Die Angle})(\text{Hydropress})+W(\text{Pressure})(\text{Bend Radius})(\text{Die Angle})$$

and, wherein the determination of springback is accomplished by using the equation by inputting data for the various factors into the equation.

10. The method of claim 6, wherein;

the determination of the first predicted springback angle in step (b) and the new predicted springback angle in step (d) are determined by using the following equation:

$$\text{Springback}=A+B(\text{Thickness})+C(\text{Pressure})+D(\text{Bend Radius})+E(\text{Die Angle})+F(\text{Hydropress})+G(\text{Thickness})(\text{Pressure})+H(\text{Thickness})(\text{Bend Radius})+I(\text{Thickness})(\text{Die Angle})+J(\text{Thickness})(\text{Hydropress})+K(\text{Pressure})(\text{Bend Radius})+L(\text{Pressure})(\text{Die Angle})+M(\text{Pressure})(\text{Hydropress})+N(\text{Bend Radius})(\text{Die Angle})+O(\text{Bend Radius})(\text{Hydropress})+P(\text{Die Angle})(\text{Hydropress})+Q(\text{Thickness})(\text{Pressure})(\text{Bend Radius})+R(\text{Thickness})(\text{Pressure})(\text{Die Angle})+S(\text{Thickness})(\text{Pressure})(\text{Hydropress})+T(\text{Thickness})(\text{Bend Radius})(\text{Die Angle})+U(\text{Thickness})(\text{Bend Radius})(\text{Hydropress})+V(\text{Thickness})(\text{Die Angle})(\text{Hydropress})+W(\text{Pressure})(\text{Bend Radius})(\text{Die Angle})$$

wherein the determination of spring back is accomplished by using said equation by inputting data for the various factors into said equation, and wherein, after step (b) the value for bend radius for the equation is replaced by a compensated die radius which is determined using the following equation:

$$\text{compensated die radius} = \frac{\text{designed part radius} \times (180 - \text{designed part angle})}{180 - \text{designed part angle} + \text{previous springback value}},$$

and wherein the previous springback value used in the above equation is the most recent new springback value determined in step (d).

* * * * *